US007707654B1

(12) United States Patent
Spence

(10) Patent No.: US 7,707,654 B1
(45) Date of Patent: May 4, 2010

(54) MASSAGE GLOVE

(76) Inventor: Peter Spence, 451 SW. 83rd Ave., North Lauderdale, FL (US) 33068

( * ) Notice: Subject to any disclaimer, the term of this patent is extended or adjusted under 35 U.S.C. 154(b) by 769 days.

(21) Appl. No.: 11/505,072

(22) Filed: Aug. 16, 2006

(51) Int. Cl.
*A41D 19/00* (2006.01)

(52) U.S. Cl. ..... 2/161.6; 2/163

(58) Field of Classification Search ..... 2/163, 2/161.6
See application file for complete search history.

(56) References Cited

U.S. PATENT DOCUMENTS 1,161,719 A * 11/1915 Norton ..... 601/154
1,539,299 A * 5/1925 Cheney ..... 601/20
5,392,482 A * 2/1995 Drulias et al. ..... 15/104.94
5,448,777 A * 9/1995 Lew ..... 2/161.7
6,669,657 B1 * 12/2003 Ongwela ..... 601/134
6,763,525 B1 * 7/2004 Spector ..... 2/69
2005/0049533 A1 * 3/2005 Beiruti ..... 601/118

* cited by examiner

*Primary Examiner*—Katherine Moran
(74) *Attorney, Agent, or Firm*—Gold & Rizvi, P.A.; Glenn E. Gold; H. John Rizvi

(57) ABSTRACT

A massage glove for use in administering a massage is provided. The massage glove includes a glove body that is configured for being worn on the hand of a user. At least one pad is carried by the glove body. The pad defines a bead pocket into which a plurality of beads are located. The pad defines a resilient pocket into which a resilient member is located. The beads are configured to be located intermediate the resilient member and the skin of the user proximate to the pad when the glove body is worn on the hand of the user.

9 Claims, 3 Drawing Sheets

MASSAGE GLOVE

FIELD OF THE INVENTION

The present invention relates generally to a massage glove that is worn by a user when administering a massage. More particularly, the present application involves a massage glove that incorporates a plurality of pads that act in combination with the hand of the user to provide an improved massage.

BACKGROUND OF THE INVENTION

Massages are commonly performed for therapeutic purposes and for the relief of stress. Although it is most common for a user to perform massage by hand, various devices are known in the art to aid a user in providing a massage. For example, hand held devices that include wheels or rollers are used for giving a more intense massage. These types of devices are held by the hand of a user and are rolled back and forth over parts of the user's body that require stress relief. Although these types of devices work well for their intended purpose, it may be the case that they cause discomfort to the person receiving the massage when the wheels or rollers are applied to bony parts of the person's body such as his or her shoulder blades. Further, as the device is held by the hand of the user, the user generally concentrates more on rolling the device and less on the actual person receiving the massage.

Other devices used to provide massages are power driven, hand held devices that deliver percussion to the body of a person receiving the massage. These types of devices generally have two or more protrusions that vibrate and may optionally apply heat to the person's skin. The user may move the device across areas of the person's body so that the protrusions apply percussive force to muscles of the person so as to relieve stress. Although these types of devices are effective at delivering a satisfying massage they may sometimes cause discomfort upon contacting bones in the shoulders or spine of the person receiving the massage. Additionally, as these devices provide a relatively strong percussive force, they may sometimes be overused to the point at which muscle soreness results in the person receiving the massage.

Another device used for providing massage is a glove that incorporates power driven vibration elements in various portions of the glove. A user may place his or her hand within the glove and turn on the device so that areas of the glove, such as the fingers, vibrate. The user can then lay his or her hands on the person so that vibration from the glove is transferred to the person receiving the massage. Aside from requiring a constant source of power to operate the glove, these types of devices may be uncomfortable for the user of the glove as it inevitably applies vibration to the hand of the user giving the massage.

As such, there remains room for variation and improvement within the art.

SUMMARY OF THE INVENTION

Various features and advantages of the invention will be set forth in part in the following description, or may be obvious from the description, or may be learned from practice of the invention.

The present invention provides for a massage glove for use in giving a massage. The glove includes a glove body that is configured for being worn on the hand of a user. At least one pad is carried by the glove body. The pad defines a bead pocket into which a plurality of beads are located. The pad also defines a resilient pocket into which a resilient member is located. The beads are configured to be located intermediate the resilient member and the skin of the user proximate to the pad when the glove body is worn on the hand of the user.

The present invention also provides for a massage glove as immediately discussed in which the bead pocket covers a greater area of the glove body than the resilient pocket.

Also provided in accordance with the present invention is a massage glove that includes a glove body that is configured for being worn on the hand of a user. A plurality of pads are included and are carried on the palmar side of the glove body. The pads have a resilient member and a plurality of beads. The plurality of beads are located intermediate the resilient member and the skin of the user proximate to the pads when the glove body is worn on the hand of the user. The plurality of beads cover a greater area of the glove body than the resilient member of the pad. Also, the resilient member has a higher resiliency than the plurality of beads.

Another exemplary embodiment of the invention exists in a massage glove as discussed above in which the resilient member is silicon gel. A further exemplary embodiment exists in a massage glove as previously discussed in which the beads are made from cured silicon gel, marble and/or glass. An additional exemplary embodiment exists in a massage glove as previously discussed in which the glove body is made of latex.

The present invention also provides for an embodiment of the massage glove as discussed above in which the pads are located on the tips of the thumb, index finger, middle finger, ring finger and little finger of the glove body. An additional exemplary embodiment exists in a massage glove as previously mentioned in which at least one of the pads is located at the palm of the glove body proximate to the index finger, middle finger, ring finger and little finger of the glove body. At least one of the pads is located at an end of the palm of the glove body opposite from the index finger, middle finger, ring finger and little finger of the glove body. At least one of the pads is located at an end of the palm of the glove body opposite from the thumb of the glove body.

An additional exemplary embodiment of the present invention resides in a massage glove as discussed above that further includes a kneading portion carried by the glove body. The kneading portion defines a bead pocket into which a plurality of beads are located. The kneading portion is located at the palm of the glove body proximate to the thumb of the glove body.

A further embodiment of the massage glove exists as described above in which the bead pocket is contoured for receiving a portion of the hand of the user when the glove body is worn on the hand of the user.

The present invention also provides for a massage glove with a glove body made of latex that is configured for being worn on the hand of a user. A plurality of pads are carried on the palmar side of the glove body and have a resilient member and a plurality of beads. The beads are located intermediate the resilient member and the skin of the user proximate to the pads when the glove body is worn on the hand of the user. The pads are located at the tips of the thumb, index finger, middle finger, ring finger and little finger of the glove body. At least one of the pads is located at the palm of the glove body proximate to the index finger, middle finger, ring finger and little finger of the glove body. At least one of the pads is located at an end of the palm of the glove body opposite from the index finger, middle finger, ring finger and little finger of the glove body. Also, at least one of the pads is located at an end of the palm of the glove body opposite from the thumb of the glove body. A kneading portion is included and is carried by the glove body. The kneading portion defines a bead pocket into which a plurality of beads are located. The kneading portion is located at the palm of the glove body proximate to the thumb of the glove body.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
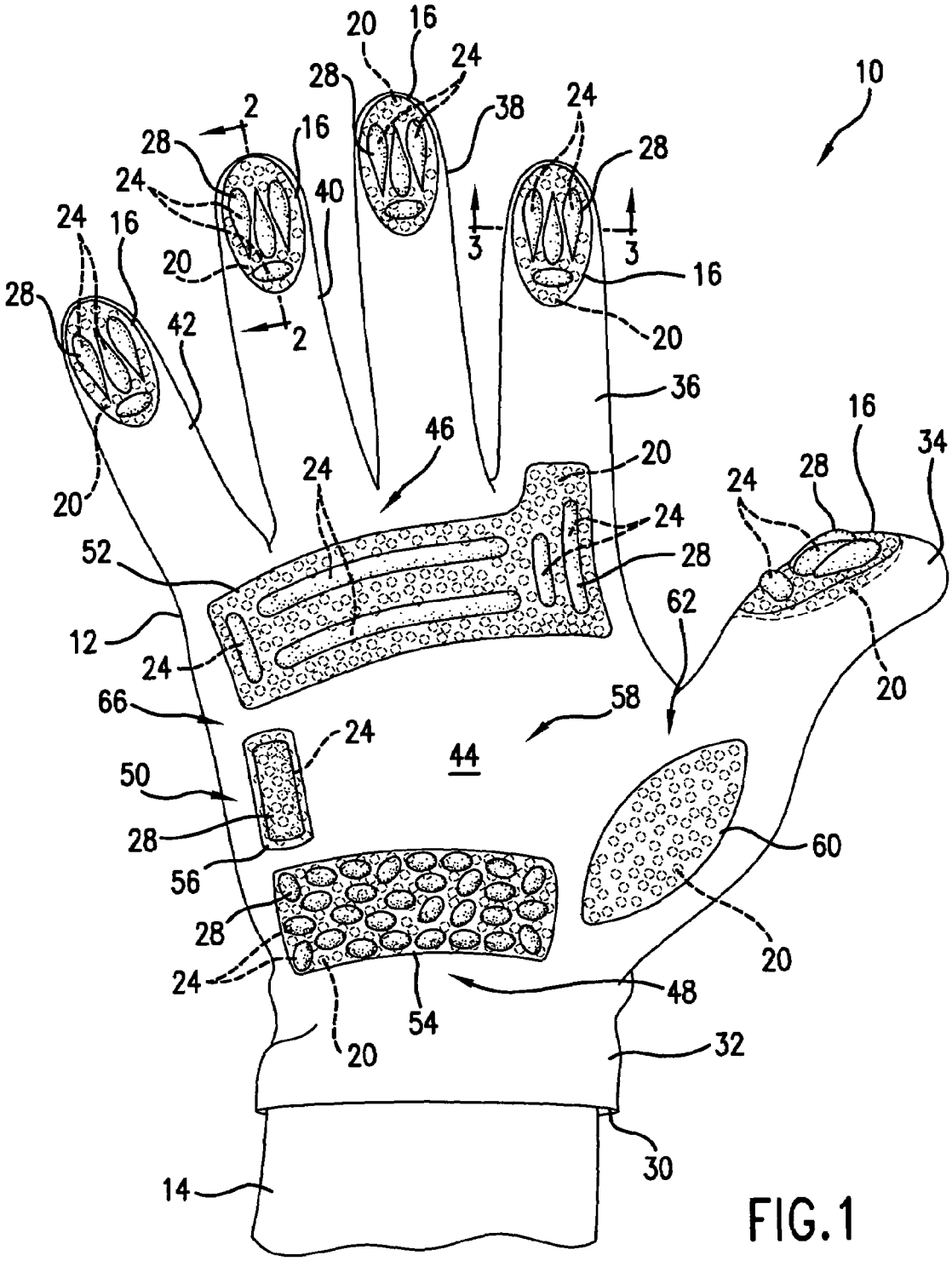
FIG. 1 is a plan view of the palmar side of a massage glove in accordance with one exemplary embodiment of the present invention.

Repeat use of reference characters in the present specification and drawings is intended to represent the same or analogous features or elements of the invention.

DETAILED DESCRIPTION OF THE PREFERRED EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to about 7 also includes a limit of up to about 5, up to about 3, and up to about 4.5.

The present invention provides for a massage glove 10 that is useful for providing an improved massage. The massage glove 10 has at least one pad 16 that includes a plurality of beads 20 and a resilient member 24. A user may don the massage glove 10 and rub the person receiving the massage. The beads 20 act to move in a circular pattern which in combination with the force and motion of the user's 14 hand gives a more stimulating and improved massage.

FIG. 1 shows one embodiment of the massage glove 10 worn on the hand of the user 14. The massage glove 10 includes a glove body 12 that may be made from a flexible, resilient material that fits snugly on the hand of the user 14. For example, the glove body 12 may be made of latex in accordance with one exemplary embodiment of the present invention. The glove body 12 can be constructed out of a material that allows the hand of the user 14 to breath. Additionally or alternatively, powder may be included in the glove body 12 to minimize perspiration within the glove body 12 and facilitate removal once the massage is complete. The glove body 12 may be formed by any suitable method of manufacture. For example, hot stamping may be employed in forming the glove body 12.

A plurality of pads 16 are carried by the glove body 12. Although a number of pads 16 are shown in FIG. 1, it is to be understood that only one pad 16 need be provided in accordance with various exemplary embodiments of the present invention. As such, any number of pads 16 may be employed. The pads 16 are located on the palmar side 66 of the glove body 12 and are at the fingertips of the thumb 34, index finger 36, middle finger 38, ring finger 40 and little finger 42 of the glove body 12. The pad 16 has a plurality of resilient members 24 that extend from the outer surface of the glove body 12. Although shown as having four resilient members 24, it is to be understood that the pads 16 on the thumb 34, index finger 36, middle finger 38, ring finger 40 and little finger 42 may have any number of resilient members 24 in accordance with other embodiments. For example, up to five resilient members 24, up to ten resilient members 24, or up to twenty-five resilient members 24 may be included in other embodiments of the massage glove 10.

Figure 2:
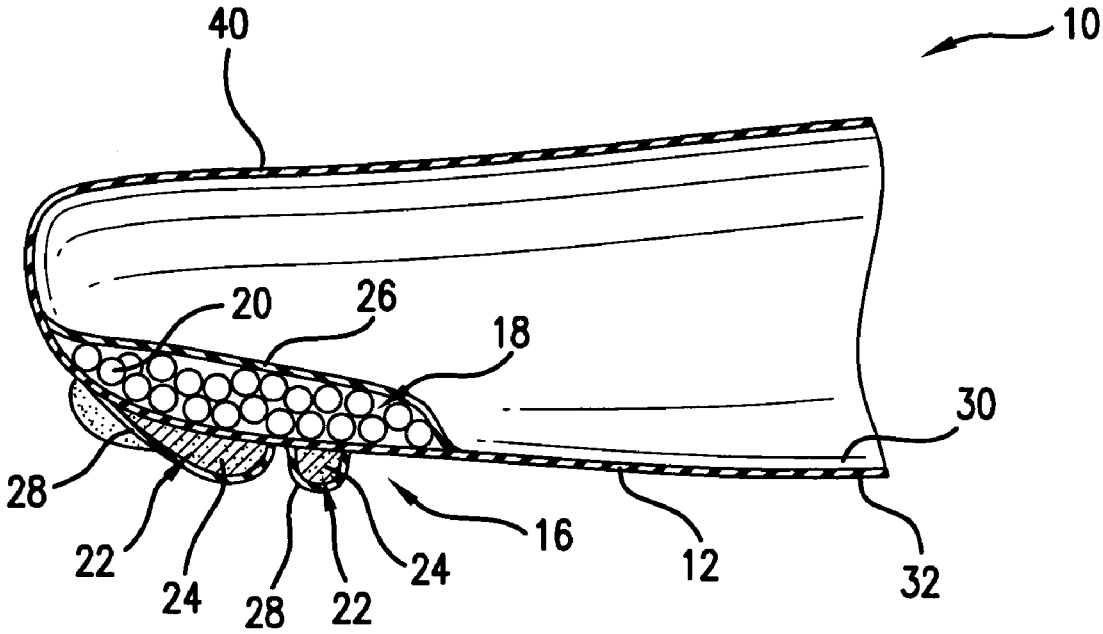
FIG. 2 is a cross-sectional view taken along line 2-2 of FIG. 1.

The pads 16 also include a plurality of beads 20 as shown more clearly in FIG. 2. The beads 20 can be spherical objects or may be irregular in shape so that they have flattened surfaces and corners. The beads 20 may move in relation to one another when force is applied thereto by the hand of the user 14. The beads 20 can be made of a variety of materials. For example, the beads 20 can be made of cured silicon gel, marble or glass in accordance with various embodiments. The beads 20 are contained within a bead pocket 18. As shown, the bead pocket 18 is defined by a bead pocket layer 26 and a portion of the glove body 12. However, it is to be understood that in other embodiments the bead pocket 18 is defined completely by the bead pocket layer 26. The bead pocket layer 26 may be made of the same or different material than the glove body 12. Further, the bead pocket layer 26 can be integrally formed with the glove body 12 or may be attached thereto though the use of adhesion or other fasteners.

Figure 3:
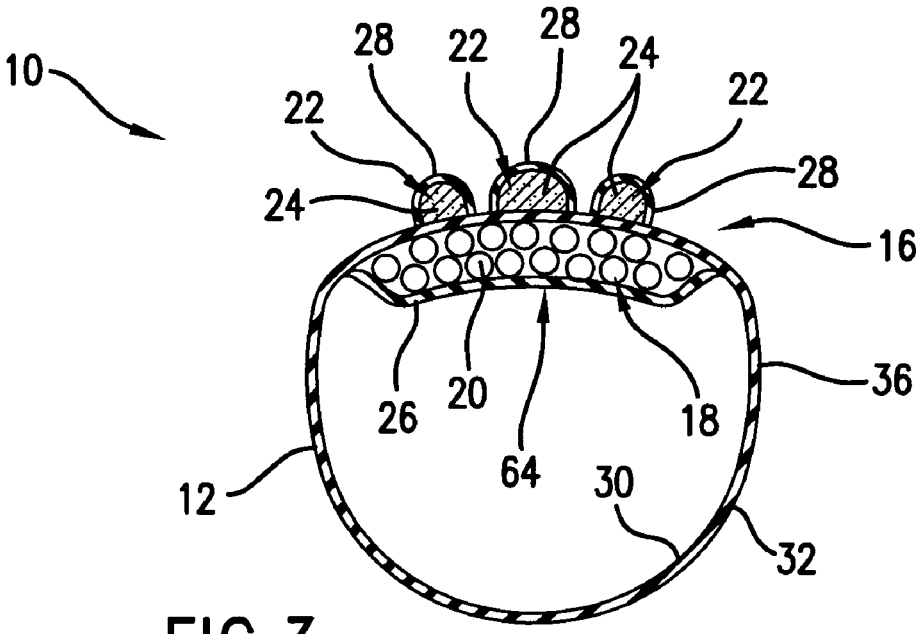
FIG. 3 is a cross-sectional view taken along line 3-3 of FIG. 1.

FIG. 3 shows a cross-section of the massage glove 10 taken along line 3-3 of FIG. 1. The bead pocket 18 has a contoured section 64 on a surface facing the skin of the user 14 when the user 14 dons the massage glove 10. The contoured section 64 acts to receive the fingertip of the user 14 and provides a greater degree of comfort to the user 14 while wearing the massage glove 10.

The resilient member 24 is contained within a resilient pocket 22. The resilient pocket 22 is defined by both the glove body 12 and a resilient pocket layer 28. As with the bead pocket layer 26, the resilient pocket layer 28 may be made of the same or different material than the glove body 12. Further, the resilient pocket 22 may alternatively be completely defined by the resilient pocket layer 28. The resilient member 24 is contained within the resilient pocket 22 so that the resilient member 24 does not escape the resilient pocket 22 during use of the massage glove 10. Although described as being within the resilient pocket 22, the resilient member 24 need not be contained either entirely or partially within a resilient pocket 22 in other embodiments. For example, in one embodiment the resilient member 24 is attached to the outer surface of the glove body 12 without the presence of a resilient pocket 22.

The resilient member 24 can be made out of any material that exhibits some degree of resiliency. For example, the resilient member 24 may be silicon gel in one embodiment. The resilient member 24 may have a higher degree of resiliency than the beads 20. As such, the beads 20 may be more rigid than the resilient member 24. In use, the user 14 places his or her hand within the massage glove 10 and provides a massage. Force imparted by the user 14 in combination with the interaction of beads 20 and resilient member 24 yields a more satisfying and intense massage. The beads 20 of the pad 16 cover a greater surface area of the glove body 12 than the resilient members 24 of pad 16. This arrangement affords greater massaging intensity. However, it is to be understood that in other exemplary embodiments that the resilient members 24 may cover the same or a larger amount of area of the glove body 12 than the beads 20 of the pad 16.

Figure 6:
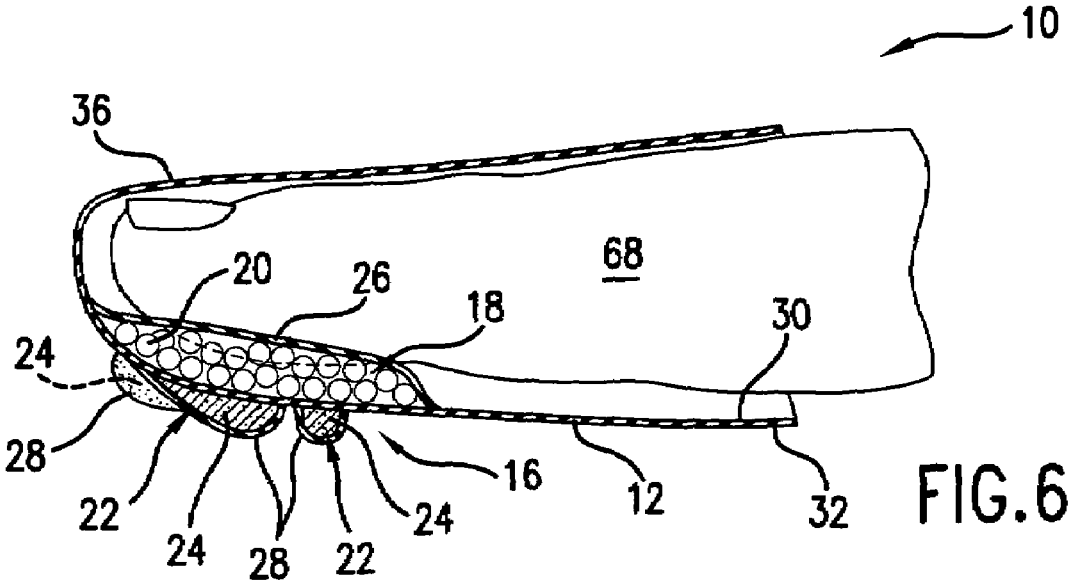
FIG. 6 is a cross-sectional elevation view of a finger of a massage glove in accordance with another alternative exemplary embodiment of the present invention.

FIG. 6 is a close-up cross-sectional view of a finger 36 of the massage glove 10 in accordance with another exemplary embodiment of the present invention. An index finger 68 of the user 14 is shown inserted into the index finger 36 of the glove body 12. The finger 68 is positioned in the glove body 12 so that the beads 20 in the bead pocket 18 are located between the resilient member 24 and the skin of the finger 68 proximate to pad 16. Although shown on the inside 30 of glove body 12, it is to be understood that the beads 20 and bead pocket 18 may be located on the outside 32 of glove body 12 in other embodiments. Likewise, although shown on the outside 32 the resilient member 24 may be located on the inside 30 of glove body 12 in other embodiments. In these other embodiments, it may be desirable to have the beads 20 located between the resilient member 24 and the skin of the finger 68 of the user 14. Application of the massage glove 10 to the person receiving the massage may cause the beads to move in a circular pattern that in turn with the resilient member 24 causes a deeper sensation of massaging.

Figure 4:
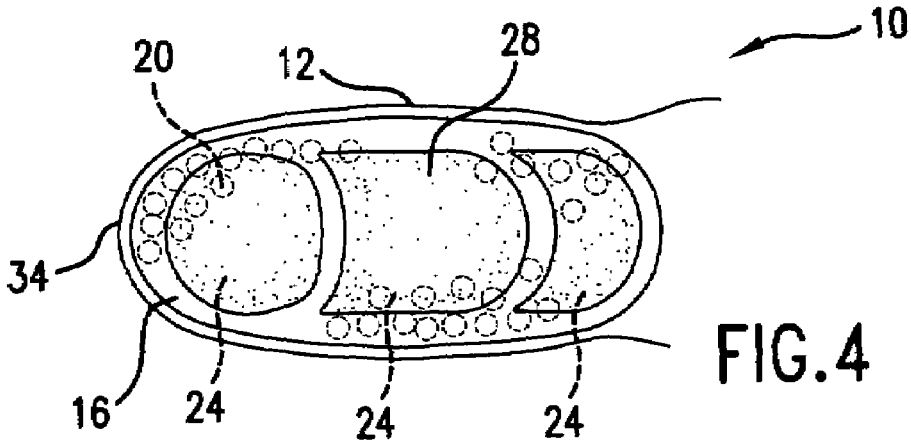
FIG. 4 is a close-up plan view of a finger of the massage glove in accordance with an alternative exemplary embodiment of the present invention.

As shown in FIG. 1, four resilient members 24 are included in the pads 16 on the thumb and fingers 34, 36, 38, 40 and 42. Three of the resilient members 24 are teardrop shaped and are arranged next to one another such that the middle resilient member 24 lays in an opposite direction than those on either side. The fourth resilient member 24 is oval shaped and is located closer to the palm of the glove body 12 than the other resilient members 24. The resilient members 24 can be provided in a variety of shapes and sizes in accordance with various exemplary embodiments. For example, FIG. 4 shows an alternative arrangement of the resilient members 24. Here, the pad 16 includes three resilient members 24 that are arranged generally in a linear fashion on thumb 34 away from palm 44. The resilient member 24 closest to the palm 44 is generally moon or crescent shaped while the resilient member 24 farthest from palm 44 is generally circular in shape. The resilient member 24 intermittent the other two is generally elongated in shape with ends complimentary to those of the facing edges of the other two resilient members 24. The resilient members 24 may have a length from 0.25 to 2 centimeters and a width from 0.50 to 1 centimeter. The resilient members 24 may have a height of 0.50 centimeters from the outer surface of the glove body 12. The beads 20 of pad 16 are arranged so that they cover a greater surface area of glove body 12 than do the three resilient members 24.

Figure 5:
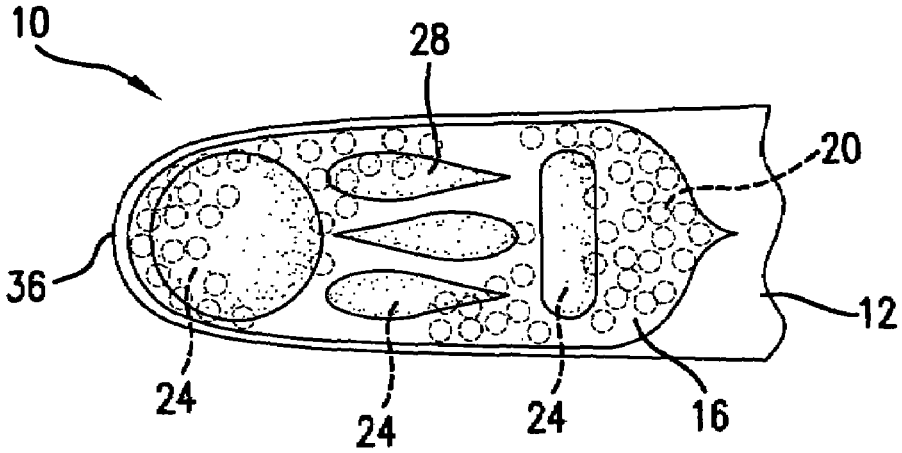
FIG. 5 is a close-up plan view of a finger of the massage glove in accordance with another alternative exemplary embodiment of the present invention.

FIG. 5 shows another alternative exemplary embodiment of the pad 16. Here, the pad 16 is located on the index finger 36 and includes five resilient members 24 thereon. Three of the resilient members 24 are tear drop shaped and are arranged across the index finger 36. The middle resilient member 24 is oriented in an opposite direction to the two on either side. The fourth resilient member 24 of the pad 16 is located closer to the palm 44 than the three previously mentioned resilient members 24 and is generally oval in shape. Finally, the fifth resilient member 24 is located a greater distance from palm than the other four resilient members 24 and is generally circular in shape. The resilient members 24 may have a length of from 0.50 centimeters to 1.5 centimeters and a width from 0.5 centimeters to 1 centimeter. Further, the height of the resilient members 24 from the surface of the glove body may be 0.5 centimeters. The beads 20 of pad 16 cover a greater surface area of glove body 12 than the five resilient members 24. The massage glove 10 may have pads 16 with the same pattern of resilient members 24 on all of the fingers and thumb 34, 36, 38, 40 and 42.

Referring back to FIG. 1, the massage glove 10 has a number of additional pads located thereon. A pad 52 is located at the palm 44 of the glove body 12 and is positioned at an end 46 of the palm 44. End 46 is located at a portion of the palm 44 proximate to the fingers 36, 38, 40 and 42 of the glove body 12. Pad 52 includes beads 20 and five resilient members 24. Resilient members 24 of pad 52 are oval shaped and have varying lengths such that some of the resilient members 24 are more elongated than others. The pad 52 is constructed in the same manner as pads 16 previously described that are located on thumb and fingers 34, 36, 38, 40 and 42. Pad 52 is positioned on the glove body 12 so that force exerted by the upper palm region of the hand of the user 14 is transferred through the pad 52 and interacts with pad 52 to produce a more intense massaging force.

Another pad 54 is carried by the glove body 12 and is located at an end 48 of the palm 44 that is opposite from the fingers 36, 38, 40 and 42. Pad 54 has a plurality of beads 20 and a plurality of resilient members 24. Again, pad 54 is constructed in a similar manner as pads 16 previously described and located on thumb and fingers 34, 36, 38, 40 and 42. A user 14 may apply force with the palm of his or her hand which is transferred through pad 54 into the person receiving the massage.

Yet another pad 56 is incorporated in the massage glove 10. Pad 56 is located at an end 50 of the palm 44 that is opposite from the thumb 34. Pad 56 has a single resilient member 24 and a plurality of beads 20. As with previously described pads 52 and 54, pad 56 may be constructed in manners similar to those discussed above with respect to pads 16 on thumb and fingers 34, 36, 38, 40 and 42. For example, the bead pockets 18 may be contoured in order to receive the corresponding portion of the hand of the user 14. Additionally, although shown in FIG. 1 as having a certain number, size and shape of resilient members 24, the pads 52, 54 and 56 may have resilient members 24 that are variously configured in other exemplary embodiments. Further, the beads 20 of pads 52, 54 and 56 may cover a greater surface area of glove body 12 than their respective resilient members 24. However, it is to be understood that the beads 20 may cover the same amount of surface or a lesser amount of surface than the resilient members 24 in other embodiments. The pads 16, 52, 54 and 56 may have resilient members 24 oriented in the same or different patterns and configurations in accordance with various exemplary embodiments. The pads 16, 52, 54 and 56 may be positioned on the glove body 12 to correlate to areas commonly involved in the application of pressure during a massage.

The massage glove 10 also has a kneading portion located at an end 62 of the palm 44 proximate to the thumb 34. Kneading portion 60 includes a plurality of beads 20 that are contained in a bead pocket 18 formed in part by a bead pocket layer 26. The beads 20, bead pocket 18 and bead pocket layer 26 may be provided in the various manners discussed with respect to these components in relation to the pad 16 on the thumb and fingers 34, 36, 38, and 42. The kneading portion 60 does not include a resilient member 24. The kneading portion 60 is used for kneading and allows for the transfer of forces from the palm region of the hand of the user 14 into the person receiving the massage. It is to be understood that in other exemplary embodiments of the present invention that the kneading portion 60 need not be present. In these instances, the kneading portion 60 may be eliminated so that only the glove body 12 is present on the end 62. Alternatively, the kneading portion 60 may be converted into a pad 16 with the addition of resilient members 24 in other embodiments. An open area 58 is present in the central area of the palm 44. In other embodiments, the palmar side 66 of the massage glove 10 may have pads 16 present across the entire palm 44 so that the open area 58 is not present.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A massage glove, comprising:

a glove body made of latex and configured for being worn on the hand of a user; and a plurality of pads carried on the palmar side of said glove body, said pads having a resilient member and a plurality of beads, wherein said plurality of beads are located intermediate said resilient member and the skin of the user proximate to said pads when said glove body is worn on the hand of the user;

wherein said pads are located at the tips of the thumb, index finger, middle finger, ring finger and little finger of said glove body;

wherein at least one of said pads is located at the palm of said glove body proximate to the index finger, middle finger, ring finger and little finger of said glove body;

wherein at least one of said pads is located at an end of said palm of said glove body opposite from said index finger, middle finger, ring finger and little finger of said glove body; and wherein at least one of said pads is located at an end of said palm of said glove body opposite from said thumb of said glove body; and a kneading portion carried by said glove body, wherein said kneading portion defining a bead pocket into which a plurality of beads are located, wherein said kneading portion is located at the palm of said glove body proximate to the thumb of said glove body; and wherein at least one of said pads has a resilient pocket layer that defines in combination with said glove body a resilient pocket, and wherein said beads are located in said bead pocket and wherein said resilient member is located in said resilient pocket.

2. A massage glove, comprising:

a glove body configured for being worn on the hand of a user; and a plurality of pads carried on the palmar side of said glove body, said pads having a resilient member and a plurality of beads, wherein said plurality of beads are located intermediate said resilient member and the skin of the user proximate to said pads when said glove body is worn on the hand of the user, wherein said plurality of beads of said pad cover a greater area of said glove body than said resilient member of said pad;

wherein said resilient member has a higher resiliency than said plurality of beads; and wherein said pad has a bead pocket layer that defines in combination with said glove body a bead pocket, and wherein said pad has a resilient pocket layer that defines in combination with said glove body a resilient pocket, and wherein said beads are located in said bead pocket and wherein said resilient member is located in said resilient pocket.

3. The massage glove as in claim 2, wherein said pad defines a bead pocket into which said plurality of beads are located, and wherein said pad defines a resilient pocket into which said resilient member is located.

4. The massage glove as in claim 2, wherein said glove body is made of latex.

5. The massage glove as in claim 2, wherein said resilient member is made of silicon gel.

6. The massage glove as in claim 2, wherein said plurality of beads are made from a material selected from the group consisting of cured silicon gel, marble and glass.

7. The massage glove as in claim 2, wherein said pads are located at the tips of the thumb, index finger, middle finger, ring finger and little finger of said glove body;

wherein at least one of said pads is located at the palm of said glove body proximate to the index finger, middle finger, ring finger and little finger of said glove body;

wherein at least one of said pads is located at an end of said palm of said glove body opposite from said index finger, middle finger, ring finger and little finger of said glove body; and wherein at least one of said pads is located at an end of said palm of said glove body opposite from said thumb of said glove body.

8. The massage glove as in claim 2, further comprising a kneading portion carried by said glove body, wherein said kneading portion defining a bead pocket into which a plurality of beads are located, wherein said kneading portion is located at the palm of said glove body proximate to the thumb of said glove body.

9. The massage glove as in claim 2, wherein said bead pocket is contoured for receiving a portion of the hand of the user when said glove body is worn on the hand of the user.

* * * * *